US008550693B2

(12) United States Patent
Fisenko

(10) Patent No.: US 8,550,693 B2
(45) Date of Patent: Oct. 8, 2013

(54) DEVICE FOR PREPARATION OF WATER-FUEL EMULSION

(75) Inventor: Vladimir V. Fisenko, St. Petersburg (RU)

(73) Assignee: Fisonic Holding Limited, Cyprus (CY)

( * ) Notice: Subject to any disclaimer, the term of this patent is extended or adjusted under 35 U.S.C. 154(b) by 0 days.

(21) Appl. No.: 13/429,296

(22) Filed: Mar. 23, 2012

(65) Prior Publication Data

US 2012/0236683 A1 Sep. 20, 2012

Related U.S. Application Data

(63) Continuation of application No. PCT/RU2010/000543, filed on Sep. 30, 2010.

(51) Int. Cl.
*B01F 5/04* (2006.01)

(52) U.S. Cl.
USPC ..... 366/163.2; 366/167.1

(58) Field of Classification Search
USPC ..... 366/163.2, 167.1; 239/419, 424
See application file for complete search history.

(56) References Cited

U.S. PATENT DOCUMENTS

| | | | | |
|---|---|---|---|---|
| 2,175,160 A | | 10/1939 | Zobel et al. | |
| 2,948,148 A | | 8/1960 | Berlin et al. | |
| 5,205,648 A | * | 4/1993 | Fissenko | 366/178.3 |
| 6,142,765 A | * | 11/2000 | Ramaseder et al. | 431/9 |
| 6,523,991 B1 | * | 2/2003 | Maklad | 366/163.2 |

FOREIGN PATENT DOCUMENTS

| | | |
|---|---|---|
| RU | 2420674 C2 | 3/2010 |
| RU | 2008138162 A | 3/2010 |

OTHER PUBLICATIONS

"Critical Two-Phase Streams" Atomizdat 1978, p. 50.
"Compressibility of the Heat Carriers . . . " Energoatomizdat 1987, p. 55.
Non-Final Office Action dated Apr. 21, 2011 in related U.S. Appl. No. 12/951,031.
Final Office Action dated Oct. 21, 2011 from related U.S. Appl. No. 12/951,031.
Non-Final Office Action dated Feb. 10, 2012 from related U.S. Appl. No. 12/951,031.
Final Office Action dated Jun. 28, 2012 from related U.S. Appl. No. 12/951,031.
English Translation of Russion patent No. RU2420674 published on Mar. 27, 2010.
English Translation of Russion patent No. RU2008138162 published on Mar. 27, 2010.

* cited by examiner

*Primary Examiner* — David Sorkin
(74) *Attorney, Agent, or Firm* — Novak Druce Connolly Bove + Quigg LLP; Jonathan A. Jaech

(57) ABSTRACT

A device for preparation of a water-fuel emulsion comprises a blending chamber, as well as a fuel nozzle and a water nozzle for supply of respective mediums in the chamber. A nozzle that ensures boiling of water is used as the water nozzle. The water nozzle comprises an inlet and outlet sections that are respectively convergent and divergent in the direction of medium flow, between which the minimal cross-section of the nozzle is located. The generatrix of a fore part of the divergent section of the nozzle has a concave shape in relation to the axis of the nozzle in the critical cross-section of the nozzle. The water nozzle is located on a longitudinal axis of the chamber while the fuel nozzle is located in line with the water nozzle and is shaped as a ring enveloping an end part of the water nozzle.

3 Claims, 1 Drawing Sheet

DEVICE FOR PREPARATION OF WATER-FUEL EMULSION

CROSS REFERENCE TO RELATED APPLICATIONS

This is a continuation patent application of PCT/RU2010/00543 filed Sep. 30, 2010, which claims priority to Russian Patent Application No. 2009136168 filed Sep. 30, 2009, now Russian Patent No. 2422193, which applications are incorporated herein in their entireties by reference.

FIELD OF THE INVENTION

The device relates to fluidics and can be used in power engineering, ship-building, and machine-building industries as well as in transport for preparation of high-quality water-fuel emulsions.

BACKGROUND OF THE INVENTION

It is known in the art a method for preparation of emulsions by means of a transonic device comprising a nozzle for supply of a working medium, means for supply of emulsified components and a blending chamber (U.S. Pat. No. 1,669,519 A1, IPC$^5$ B01F5/04, A23C11/00, published in 1991). In this device, steam is used as a working medium, and an disadvantage limiting the application of this device is a reduced ratio range of the working and homogenized media as the steam has a high heat-absorption capacity and already at its content of 10% in the blend, that leads to essential increase of the blend temperature and volumetric content of the steam (gas) constituent of the blend, that results in sharp increase of the sound velocity in the blend (compressibility of the decreases) before a pressure drop, which sharply decreases the intensity of the pressure drop and leads to a deterioration of the obtained emulsion quality.

It is also known in the art a device for preparation of a water-fuel emulsion, which device comprises a blending chamber as well as a fuel nozzle and a water nozzle for supply of respective mediums to the blending chamber (patent RU 1761241 A1 IPC$^5$ B01F5/04, published in 1992). To eliminate the disadvantage of the device according to the above-stated patent by means of ensuring the possibility to extend the range of the ratio of components blended, it was proposed to use not cold water and steam as the working medium for generation of a supersonic flow in this device. At that, an increase in the blend velocity was achieved through an increase in the pressures of the working and homogenized mediums that still led to an increase of power consumption (to a necessity to increase the power of pumps), and a reduction of the sound velocity in the blend was achieved by a release of gas dissolved in water and homogenized medium through a decrease of the pressure before the pressure drop below a saturation pressure level. Value of the pressure before the drop at the given inlet pressure of the device depends on the volumetric ratio of phases before the drop. The greater the volume of the gas constituent, the lower the pressure before the drop, the higher the blend velocity, the greater the Mach number (the higher compressibility) and the more intense the pressure drop (it is proportional to the square of the Mach number). As a result, the quality of the obtained water-fuel emulsion is improved. However, the use of cold water as the working medium in this device limits the volumetric ratio of phases to the range of 0.4 to 0.7 that significantly restricts the range of the Mach numbers used (1.67 to 1.83) and gives a narrow range and low intensity of the pressure drop (2.78 to 3.33).

Meanwhile, the Mach number can reach the value of 6 at the water temperature of 150° C., while the intensity of the pressure drop is increasing by more than one order of magnitude.

SUMMARY OF THE INVENTION

It is an object of the present invention to provide a device for preparation of a water-fuel emulsion, which device ensures a reduction in power consumption while simultaneously improving the emulsion quality.

This object is achieved by that in the device for preparation of a water-fuel emulsion comprising a blending chamber as well as a fuel nozzle and a water nozzle for supply of respective mediums to the blending chamber, according to the present invention, a nozzle that ensures boiling of water is used as the water nozzle.

In the present invention, as the water nozzle ensuring the boiling of water, it is preferably used a nozzle comprising an inlet section convergent in the direction of the medium flow and an outlet section divergent in the direction of the medium flow, wherein a minimal cross-section of the nozzle is located between said sections.

At that, the most optimal form of the water nozzle is a form in which the generatrix of a fore part of the divergent section of the water nozzle is a concave curve in relation to a longitudinal axis of said nozzle, which curve goes smoothly into a convex curve in relation to the longitudinal axis of said nozzle in a critical cross-section of said nozzle.

Moreover, the water nozzle is located on a longitudinal axis of the blending chamber while the fuel nozzle is located in line with the water nozzle and shaped as a ring enveloping an end part of the water nozzle. An outlet cross-section of the fuel nozzle is preferably shaped as openings symmetrically located around a longitudinal axis of the water nozzle.

Use of a water nozzle that ensures the boiling of water in the present invention makes possible an expansion of the range of volumetric ratio of phases in the blend and thus enables the supply of the working medium (water) and homogenized (emulsified) medium (fuel) under lower pressure that provides a reduction in power consumption and improves the emulsion quality.

As the water nozzle ensuring the boiling of water, it can be used, for example, a Laval nozzle, or an evaporation nozzle described in patent SU 1268867 A1, IPC F22B 3/04, 1986. But the most optimal in terms of increase of efficiency of pressure energy conversion into kinetic energy of a two-phase gas-liquid flow of the medium is a shape of the water nozzle in which the generatrix of a fore part of the divergent section of the water nozzle is a concave curve in relation to a longitudinal axis of said nozzle, which curve goes smoothly into a convex curve in relation to the longitudinal axis of said nozzle in a critical cross-section of said nozzle.

The device according to the present invention is illustrated with reference to the accompanying drawings.

DETAILED DESCRIPTION OF THE INVENTION

Figure 1:
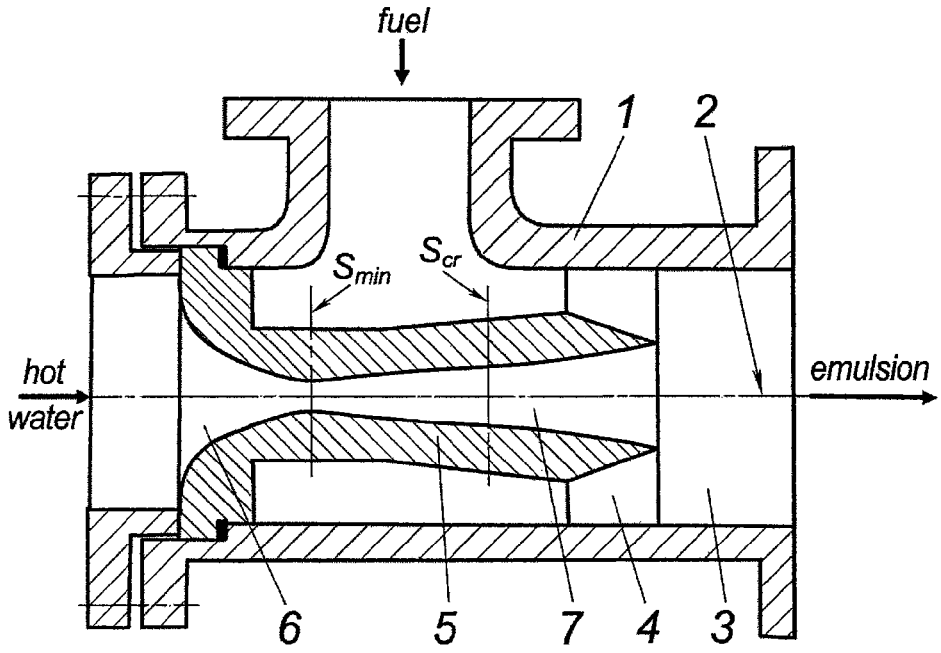
FIG. 1 is a scheme of the device for preparation of a water-fuel emulsion according to the present invention.

The claimed device for preparation of a water-fuel emulsion comprises a cylindrical blending chamber 3 as well as a fuel nozzle 4 (a nozzle for fuel supply) and a water nozzle 5 (a nozzle for boiling water supply) for feeding of respective medium into the blending chamber), which all are installed in a casing 1 along a common longitudinal axis 2.

The water nozzle 5 comprises an inlet section 6 convergent in the direction of the medium flow and an outlet section 7 divergent in the direction of the medium flow. Between said sections a minimal (narrowest) cross-section $S_{min}$ of the nozzle 5 is located. The generatrix of the fore part of the divergent section 7 of the water nozzle 5 is a curve of a concave shape in relation to the axis 2, which curve goes smoothly into a convex curve in relation to the axis 2 in a critical cross-section $S_{cr}$ of said nozzle. In other words, the second derivative of the generatrix of the fore part of the divergent section of the nozzle with respect to the length of the latter has a negative value; this derivative equals zero in the critical cross-section $S_{cr}$ of the nozzle 5 and has a positive value after the critical cross-section.

The term "critical cross-section of the nozzle" is a widely used term in the fluidics and means a cross-section of the nozzle, in which the local velocity of a gas flow reaches the speed of sound.

In the course of the conducted experimental works, it was determined that the above-mentioned shape of the water nozzle 5 enables an increase in the efficiency of conversion of pressure energy into kinetic energy of the flow with boiling of water in the flowing part of the nozzle as compared to the known Laval nozzle. The water nozzle 5 used in the present invention differs from the Laval nozzle and is characterized in the following:

the water nozzle 5 is subsonic not only in its convergent section 6 but also in some part of the divergent section 7;

a maximum specific consumption of the medium is set in the minimal cross-section $S_{min}$ of the nozzle 5 but this cross-section is not critical;

the critical cross-section $S_{cr}$ in which the flow velocity equals to the local sound velocity is shifted in the nozzle 5 downstream and is in the divergent section 7 of the nozzle 5;

not the first derivative and the second derivative of the cross-sectional area with respect to the length of the nozzle 5 equals zero in this critical cross-section $S_{cr}$; thus a function of dependence of the cross-sectional area of the nozzle 5 on its length in the critical cross-section $S_{cr}$ has not a minimum, as in the Laval nozzle, but an inflection point of said function.

As it seen from FIG. 1, the fuel nozzle 4 is made in the shape of a ring enveloping the end part of the water nozzle 5.

FIG. 1 also shows that the sum of areas of outlet cross-sections of the nozzles 4 and 5 equals the area of the inlet cross-section of the cylindrical blending chamber 3. If we set the area of the outlet cross-section of the fuel nozzle 4 as $f$, and the area of the inlet cross-section of the chamber 3 as F, then the area of the outlet cross-section of the water nozzle 5 will make F-$f$. The length of the blending chamber 3 equals or greater than its six diameters. Volumetric ratio of phases β at the inlet of the blending chamber 3 is:

$$\beta = 1 - \frac{f}{F}.$$

Thus, the volumetric ratio of phases β for the claimed device is the relation of the cross-section F-$f$ occupied with vaporous medium (boiled water) to the total area F occupied with fuel and vaporous medium and equal to the cross-section at the inlet of the blending chamber 3 (before the pressure drop).

$$\text{Isentropic exponent } k = 0.592 + \frac{0.7088}{1 - \frac{f}{F}}$$

$$\text{Mach number } M = \left(\frac{F}{f}\right)^5.$$

If pressure at the inlet of the nozzle 5 is $P_o$, then pressure at the inlet of the blending chamber 3 before the drop is $$p = \frac{P_0 f}{kF}.$$

If in the known device of the patent RU 1761241, the volumetric ratio of phases at the inlet of the blending chamber was within the range of 0.4 to 0.7, then this ratio in the present device will always be over 0.7. Therefore, the greater Mach number, greater pressure drop at the outlet of the nozzle 5, greater range of stable operation of the device and better quality of the emulsion are achieved in the present device.

Figure 2:
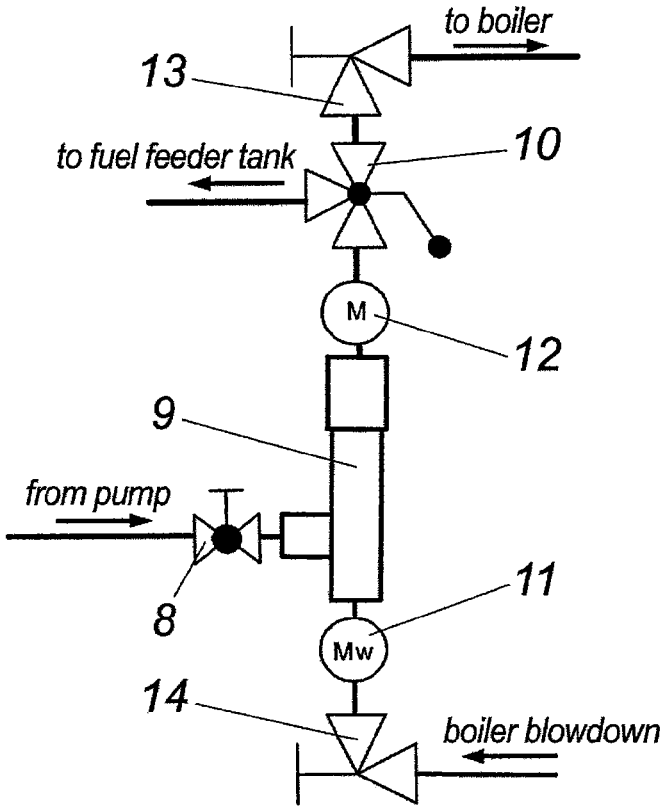
FIG. 2 is a scheme of use of the device for preparation of a water-fuel emulsion according to the present invention when supplying the prepared water-fuel emulsion to the heat boiler.

The present device functions in the scheme for supply of the obtained water-fuel emulsion to the heat boiler (FIG. 2) as follows:

A fuel pump (not shown) supplies a fuel from a fuel feeder tank (not shown) under atmospheric pressure via a valve 8 to an inlet of the present device 9 (shown in FIG. 1 in detail) to produce a water-fuel emulsion. The fuel is fed into the blending chamber 3 via the fuel nozzle 4 (FIG. 1) of the device and returns to the fuel feeder tank via a bypass valve 10. At that, a minimum pressure is observed by a pressure-and-vacuum gauge 11 due to the pressure drop in the blending chamber 3 of the device 9 while a pressure that approximately equals to atmospheric pressure is observed by a pressure gauge 12. Then, the valve 10 is gradually closed to the fact feeder tank and opened to the heat boiler (not shown) while a valve 13 is closed. The pressure of the pressure gauge 12 starts growing but pressure of the pressure-and-vacuum 11 remains the same. As soon as the pressure of the pressure-and-vacuum gauge 11 starts growing when further opening the valve 10, an opening of the valve 13 is started, which valve holds the pressure of the pressure-and-vacuum gauge 11 constant until complete closing of the valve 10 to the fuel feeder tank. In this case, the heat boiler is operated on fuel.

Then, hot water is fed to the water nozzle 5 of the device 9 by opening of a valve 14. In the blending chamber 3 it is occurred an exchange of a kinetic momentum between the fuel and a steam-water flow of the boiling water, velocity of the blend flow increases rapidly, the Mach number increases, and the pressure drop in blending chamber 3 grows. At that, the temperature of the water-fuel emulsion increases and its viscosity decreases. The water being evenly distributed in the fuel boils when entering into a combustion chamber of the heat boiler via valve 13. As a result, the water volume increases hundreds times that leads to a separation of the fuel substance into molecule groups. That intensifies the combustion process while the water dissociates releasing hydrogen that also results in reduction of the specific fuel consumption.

As shown on FIG. 1, the fuel nozzle 4 is made in the shape of an annular slot. However, in the eases where the fuel consumption is small and it is structurally difficult to provide an accordance of the annular slot size with the required area $f$ of the outlet cross section of the nozzle 4, said outlet cross-section can be done as separate openings symmetrically located around the axis 2 at an angle of less than 30°. In this case, the area $f$ will be equal to the sum of the areas of said openings.

The present device was tested on a stand for preparation of an emulsion of water and diesel fuel. Content of the water in the emulsion was over 30%, whereas the blend was quality and its combustion was stable that enabled reduction in the fuel consumption of the boiler by more than 30% without decrease in its power.

The invention claimed is:

1. A device for preparation of a water-fuel emulsion comprising a blending chamber as well as a fuel nozzle and a water nozzle with respective outlets into the blending chamber, wherein the water nozzle is aligned along a longitudinal axis of the fuel nozzle and comprises an inlet section convergent in the direction of medium flow and an outlet section continuously divergent in the direction of the medium flow with a minimal cross-section of the water nozzle located between the inlet and outlet sections, and wherein a surrounding wall of the outlet section is defined by a generatrix around the longitudinal axis, the generatrix comprising a concave curve relative to a central axis of the outlet section in an upstream portion of the outlet section transitioning through a smooth transition to a convex curve relative to a central axis of the outlet section in a downstream portion of the outlet section.

2. The device according to claim 1, wherein the smooth transition is located in a critical cross-section of the water nozzle.

3. The device according to claim 1, characterized in that the fuel nozzle is located in line with the water nozzle and shaped as a ring enveloping an end part of the water nozzle.

* * * * *